US006857300B1

(12) United States Patent
Heeley et al.

(10) Patent No.: US 6,857,300 B1
(45) Date of Patent: Feb. 22, 2005

(54) DOOR LOCKING DEVICE

(76) Inventors: Peter Heeley, Liety Dafydd Meifod, Powys SY22 6HL (GB); Philip David Jones, 9 Porthill Gardens, Shrewsbury, Shropshire SY3 9SH (GB)

( * ) Notice: Subject to any disclaimer, the term of this patent is extended or adjusted under 35 U.S.C. 154(b) by 0 days.

(21) Appl. No.: 09/979,909

(22) PCT Filed: May 19, 2000

(86) PCT No.: PCT/GB00/01920

§ 371 (c)(1),
(2), (4) Date: Nov. 16, 2001

(87) PCT Pub. No.: WO00/71841

PCT Pub. Date: Nov. 30, 2000

(30) Foreign Application Priority Data

May 19, 1999 (GB) ..... 9911593
Mar. 14, 2000 (GB) ..... 0006157

(51) Int. Cl.[7] ..... E05B 13/06

(52) U.S. Cl. ..... 70/472; 70/210; 70/224; 70/480; 70/481

(58) Field of Search ..... 70/209–210, 224, 70/472, 480–481; 292/359

(56) References Cited

U.S. PATENT DOCUMENTS 1,688,240 A * 10/1928 Keigwin ..... 292/169.16
4,720,127 A * 1/1988 Doolan ..... 292/169.22
4,900,073 A * 2/1990 Doolan ..... 292/169.22
4,920,773 A * 5/1990 Surko, Jr. ..... 70/224
5,077,994 A * 1/1992 Trull et al. ..... 70/224
5,433,495 A * 7/1995 Uffner ..... 292/169
5,651,280 A * 7/1997 Park ..... 70/472

FOREIGN PATENT DOCUMENTS

DE 3840183 A1 * 5/1990 ..... E05B/13/10

* cited by examiner

*Primary Examiner*—John B. Walsh
*Assistant Examiner*—Christopher Boswell
(74) *Attorney, Agent, or Firm*—Allen, Dyer, Doppelt, Milbrath & Gilchrist, P.A.

(57) ABSTRACT

A locking device (1) is provided for a door latch in which a latch bar of the door latch mechanism is turnable to retract a latch bolt of the latch mechanism. A locking means is adapted to be actuated in response to turning of a door handle (3) for the latch mechanism in anti-clockwise direction so as to lock the latch bolt in its extended latching position. It is released by turning the handle in the clockwise direction.

28 Claims, 8 Drawing Sheets

DOOR LOCKING DEVICE

FIELD OF THE INVENTION

The present invention relates to locking devices for door latches of the type which may be released to enable opening of a door by turning one of the associated door handles on opposite sides of the door. The locking device enables the latch to be locked in its latched position from one side of the door and prohibits the door from being opened by turning of the handle on the opposite side.

BACKGROUND OF THE INVENTION

Door latches are used to retain doors, gates and the like in closed positions and, typically, comprise a spring loaded latch bolt which is resiliently urged outwardly of the latch into a latching position in which it is engageable with a retainer or catch on an adjacent door frame to latch the door in its closed position. The latch is retracted in order to permit opening of the door by turning of a square section bar which projects from opposite sides of the latch and the door and which may be turned by handles fitted to opposite ends of the bar. The handles may be knobs or lever arms. If a door having such a latch mechanism is to be locked in its latched position, the latch normally incorporates a separate key-operated bolt or, alternatively, one or both latch handles may be fitted with a complicated central locking mechanism actuated by a central push button or turnable member.

U.S. Pat. No. 1,688,240 comprises a spring loaded latch bolt which is resiliently urged outwardly to engage a catch in the door jamb and which is retractable in response to turning of either of a pair of coaxial latch bars, each fitted with a door knob. To lock the door from the inside, when it is closed, the inside door knob is turned in either direction. This knob is coupled by its latch bar to a cam which, in response to turning of the knob, pushes a locking member mounted on the latch bar, within the latch mechanism, so that a part of the locking member engages a slot in the housing of the mechanism. When engaged with the slot, the locking member prevents the other latch bar from turning so that the outside door knob cannot be turned. Hence, the door cannot be opened from the outside. To release the outside knob, the inside knob must first be turned to retract the latch bolt and this enables the door to be opened. When the door is opened, the inside knob has to be released by the user to enable the spring loaded bolt to extend beyond the door, whereupon the latch bolt pulls the locking member from the slot, thus releasing the outside door knob.

U.S. Pat. No. 5,433,495 also discloses a door latch mechanism within a body of a door, comprising a latch bolt which is retractable in response to turning of a door knob on either side of the door. One of the knobs is designed to be pushed in towards the door to prevent the latch bolt from being retracted by either knob. To enable the door knobs to be able to subsequently retract the latch bolt, the same door knob is then pulled out.

CH-A-565307 discloses a sash window with a crank handle and a spring biased lock.

SUMMARY OF THE INVENTION

An object of the present invention is to provide a locking device for the latch bolt of a door latch mechanism, which device may be actuated by a turning action of the door handle also used to retract the latch bolt for opening of an associated door.

According to one aspect of the present invention there is provided a locking device for use with a door latch mechanism in which the door latch mechanism has a latch bar which is turnable to retract a latch bolt of the door latch mechanism by turning of a door handle at either end of the latch bar, the locking device being characterised by locking means adapted to be actuated to prohibit turning of the latch bar and retraction-of the latch bolt, and cam means for controlling the locking means and adapted to be coupled to the latch bar, whereby the locking means is actuated by turning of the cam means in response to turning of one of the door handles of the door latch mechanism in one direction, whereafter the locking means is releasable by turning of the cam means in response to turning of said one door handle in the opposite direction.

Preferably, the cam means is coupled to the latch bar by coupling means enabling the cam means to turn relatively to the latch bar, when turned in said one direction. The coupling means may comprise a passageway in the cam means for fitting the cam means to the latch bar, said passageway having an internal profile which enables the cam means to turn through a limited arc of movement relative to the latch bar, when turned in said one direction.

The locking means may comprise first means turnable with the latch bar and second means which is engaged with the first means to prohibit turning of the latch bar in response to turning of the cam means in said one direction, and which is disengaged from the first means by turning the cam means in the opposite direction.

In one embodiment, the second means comprises a slidable locking member controlled by the cam means. The first means may comprise a detent, and the slidable locking member may be engagable with the detent to prohibit turning of the latch bar. The detent may be disposed on a rotatable locking member adapted to be mounted on the latch bar so as to turn therewith.

It may be desirable for the cam means to be profiled to prevent the slidable locking member from engaging the first means when the cam means is turned in said opposite direction whilst permitting the slidable locking member to engage the first means when turned in said one direction. The cam means may have a recess which permits the slidable locking member to move into engagement with the first means, said recess having a stop portion at one end which prevents the cam means from turning further in said one direction upon engagement of the locking member in the recess, and a ramp portion at its opposite end to ease the locking member from the recess when the cam means is turned in the opposite direction.

The locking device may include a door handle with the cam means integral with the handle. Conveniently, the handle is rotatably mounted in a housing adapted to be secured in a fixed position relative to the door latch mechanism. The second means may be mounted in said housing.

The coupling means of the locking device may comprise a first part in the cam means and a second part turnable with the latch bar which the first part is adapted to engage, the cam means being able to turn through a limited arc of movement relative to the latch bar, when turned in said one direction, when the coupling parts are disengaged.

The locking device may have indexing means for indexing the door handle alternatively in either of two positions in one of which the latch bar is prohibited from turning, and in the other of which the latch bar is free to turn.

According to this aspect of the present invention there is provided an auxiliary locking device, which may be fitted to an existing latch. In this case, the locking device with a handle is fitted in place of one of the original latch handles in order to provide the latch with a locking facility, so that a door can be locked from one side and cannot be opened by turning the latch handle attached to the latch bar on the opposite side of the door.

According to another aspect of the present invention there is provided a door latch mechanism comprising a latch bolt which is retractable in response to turning of a latch bar, characterised by locking means adapted to be actuated in response to turning of a door handle fitted to the latch bar to prohibit retraction of the latch bolt by turning of a handle on the opposite side of the door, whereafter the locking means is releasable by turning said one handle in the opposite direction.

The locking means of the latch mechanism may be adapted to be actuated to prohibit turning of the latch bar, and include cam means for controlling the locking means, which cam means is coupled to the latch bar, whereby the locking means is actuated by turning of the cam means in response to turning of said one door handle in one direction, and the locking means is releasable by turning of the cam means in response to turning of said one door handle in the opposite direction.

In one embodiment, the cam means of the latch mechanism is coupled to the latch bar by coupling means enabling the cam means to turn relatively to the latch bar, when turned in said one direction, the coupling means comprising a passageway of rectangular cross-section in the cam means by which the cam means is coupled to the latch bar and wherein the latch bar has an external profile which enables the cam means to turn through a limited arc of movement relative to the latch bar, when turned in said one direction.

In another embodiment, the latch mechanism may include first and second coaxial latch bars for projecting from opposite sides of the door, the locking means comprising actuating members on said latch bars, the actuating members being engageable with the latch bolt, whereby at least one of the latch bars is rotatable in said one direction to cause its actuating member to engage the latch bolt and prohibit retraction thereof by turning of the other latch bar.

BRIEF DESCRIPTION OF THE DRAWINGS

Embodiments of the present Invention will now be described, by way of example, with reference to the accompanying drawings, in which.

DETAILED DESCRIPTION OF THE PREFERRED EMBODIMENTS

Figure 1:
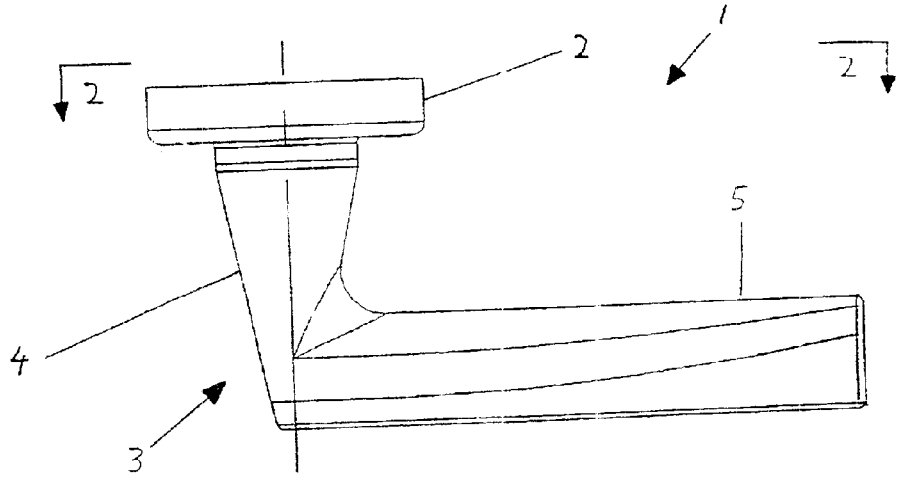
FIG. 1 is a plan view of one embodiment of the invention.

The locking device 1 illustrated In FIGS. 1 to 16 of the accompanying drawings is designed for fitting to the latch bar of a door latch inset within the body of a door between opposite sides of the door. The latch bar is of square cross section and projects from opposite sides of the door and a normal door handle is fixed to the end of the latch bar at one side of the door and the locking device is fitted to the end of the latch bar on the opposite side to permit the door to be locked from that side. As is conventional, the latch includes a spring loaded latch bolt which is resiliently urged into a projecting position for engaging a catch on the door frame so as to latch the door in a closed position. The latch bar is coupled to the latch bolt by a conventional latch mechanism which operates to retract or withdraw the latch bolt into the latch casing and disengage it from a cooperating door catch, in response to turning of the latch bar, so as to permit the door to be opened.

Referring to FIGS. 1 to 12, the locking device 1 comprises a cast metal housing or escutcheon 2 in which is journalled a door handle 3. This door handle comprises a generally conical body 4 from the outer end of which projects a lever arm 5 by which the handle may be manually turned. The opposite end of the body 4 has a cylindrical part 6 of reduced diameter compared to the diameter of the adjoining part of the body. This reduced diameter part 6 projects into the housing 2 through a suitable hole in the housing and is journalled in an annular collar 7 projecting from the housing, about the hole, by means of a sleeve 8 (see also FIG. 8). The sleeve has an annular flange 9 projecting between and in abutting relation with both the free end of the collar 7 and the body 4. It is prevented from turning in the collar by grooves 10 of the sleeve 8 engaging cooperating ribs 11 (FIG. 12) projecting from the inside of the collar 7. The sleeve has first and second pockets 12,13 spaced circumferentially about its inner periphery for engaging a dome shaped detent 14 mounted in the cylindrical part 6 of the handle for indexing the handle in the rest and locked positions, respectively. The detent is mounted in a socket 15 (FIGS. 4 and 7) in the cylindrical part 6 and is spring biassed towards the surrounding sleeve 8. The handle 3 is secured to the housing 2 by means of a circlip 16 fitted to the cylindrical part 6 of the body 4 and abutting the inside of the housing.

Figure 5:
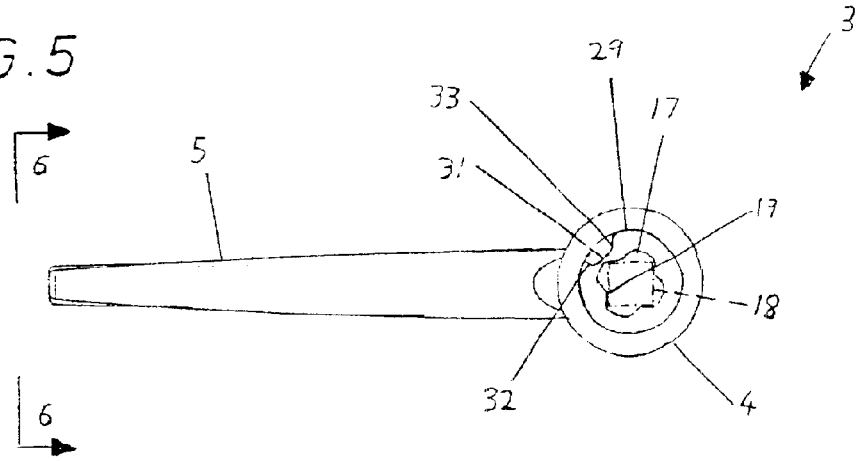
FIGS. 5 to 12 illustrate details of the locking device.
Figure 6:
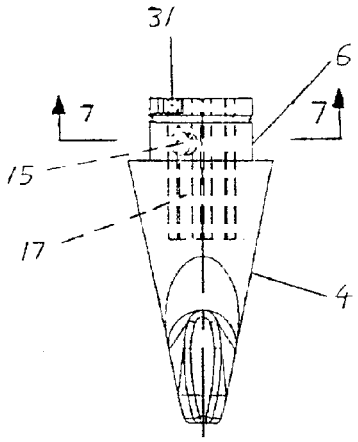
Figure 7:
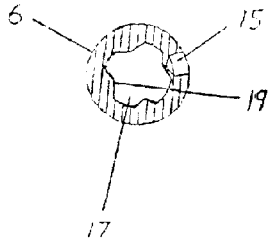
Figure 8:
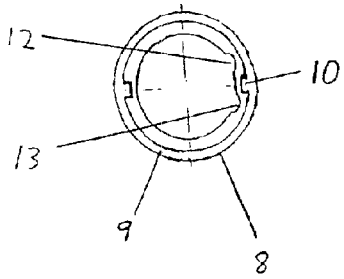
Figure 9:
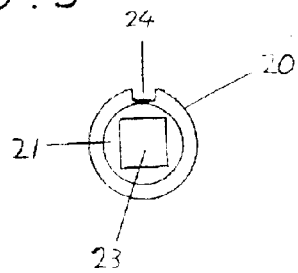
Figure 10:
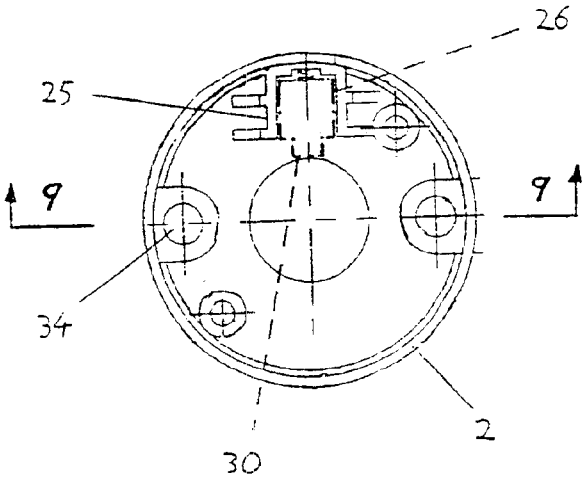
Figure 12:
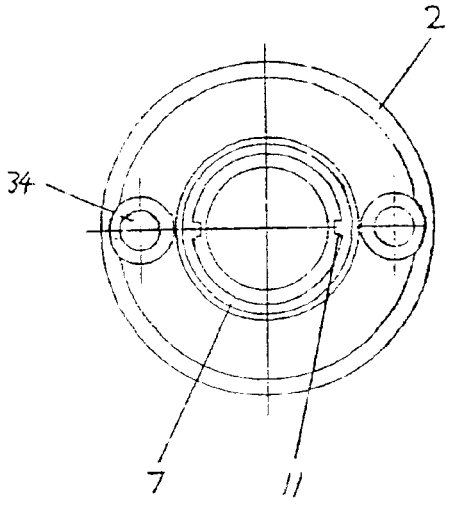
Figure 11:
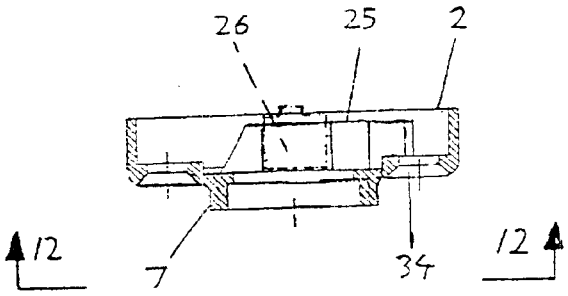

The handle body 4 has a blind passageway 17 extending into the body from the inner end thereof opposite the lever arm 5 and fitting onto the adjacent projecting end of the latch bar 18 (shown in chain dotted lines on FIG. 5). The passageway 17 has an internal profile formed from specially designed longitudinally extending ribs 19 which are arranged so as to enable the handle to engage and turn the square section latch bar, when the handle is turned in a clockwise direction from the rest position, and enable the handle to turn relatively to the latch bar when the handle is turned in an anti-clockwise direction from the rest position.

Disposed in the housing 2, adjacent the inner end of the part 6 of the handle body 4, is an annular cam or locking bush or member 20. (see also FIG. 9) which has a collar 21 projecting from its end opposite the part 6 and journalled in a suitable hole in a base plate 22 attached to the housing 2. The locking bush is rotatable relative to the housing and base plate and has a central, square aperture 23 for engaging the latch bar and a locking notch or recess or detent 24 in its periphery.

Cast on the inside of the housing 2, adjacent its periphery, is a locking bar guide 25 (see FIGS. 10 and 11 ) which is in the form of a channel that is radially disposed to the axis of rotation of the handle 3. The guide mounts a locking bar or member 26 which is slidable radially in the channel and is spring biased towards the locking bush 20 and the cylindrical part 6 of the handle body 4. The locking bar includes a protrusion 27 which is slidable in a guide slot 28 in the base plate 22 and aligned with the locking bar guide 25. The inner end of the cylindrical part 6 has a cam surface formed on its periphery for controlling movement of the locking bar. At its radially inner end the locking bar has a cam follower portion 30 in engagement with the cam surface and the latter includes a camming recess 31 which, when the handle 3 and cylindrical part 6 are turned to a predetermined locking position, permits the locking bar to clip into engagement with the notch 24 in the locking bush 20. One end 32 of the camming recess serves as a stop which engages the cam follower portion 30 of the locking bar 26 to prevent further turning of the cylindrical part 6 and handle 3 once the locking bar is engaged with the notch 24 in the locking bush 20 and the opposite end 33 of the camming recess is inclined or ramped to facilitate disengagement of the locking bar from the notch when the handle is turned in the opposite direction.

The housing 2 of the locking device 1 is attached to one side of a door by means of screws, with the passageway 17 of the handle body 4 engaged-with the latch bar 18. Holes 34 are provided through the wall of the housing and in the base plate 22 for these screws.

The handle 3 maybe a JPS Raven handle or equivalent. The housing 2 may be a zinc alloy coating, the sleeve 8 may be of nylon and the detent 14 may be of brass. The base plate 22 may be stamped from steel plate and may have a thickness of 1.5 mm.

Figure 2:
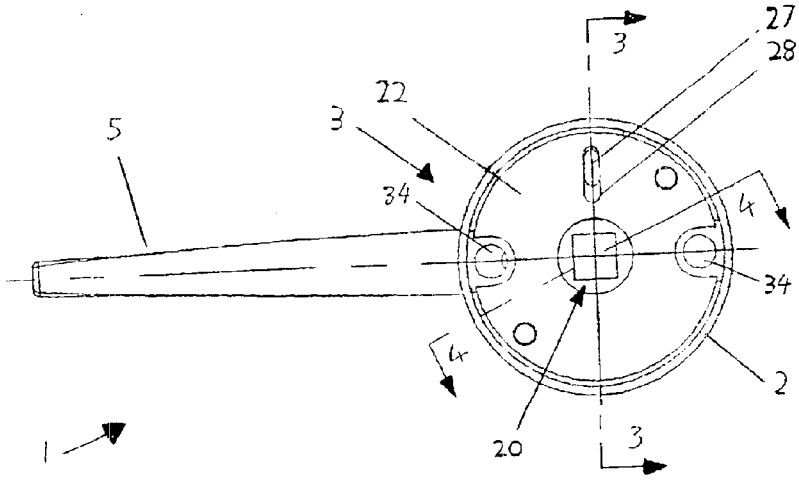
FIG. 2 is a rear elevational view taken along lines 2—2 of FIG. 1.
Figure 3:
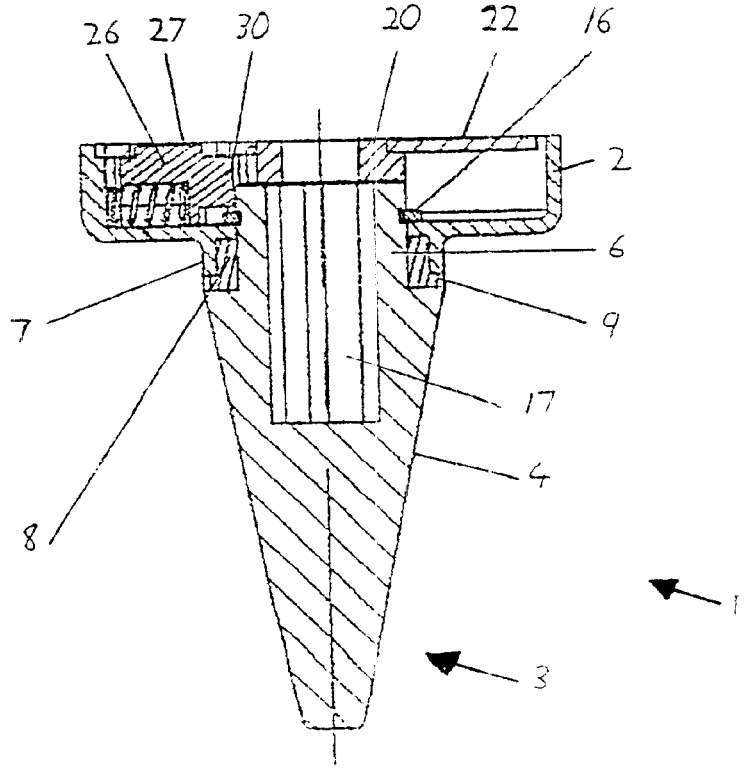
FIGS. 3 and 4 are sectional views taken along lines 3—3 and lines 4—4 of FIG. 2 respectively.
Figure 4:
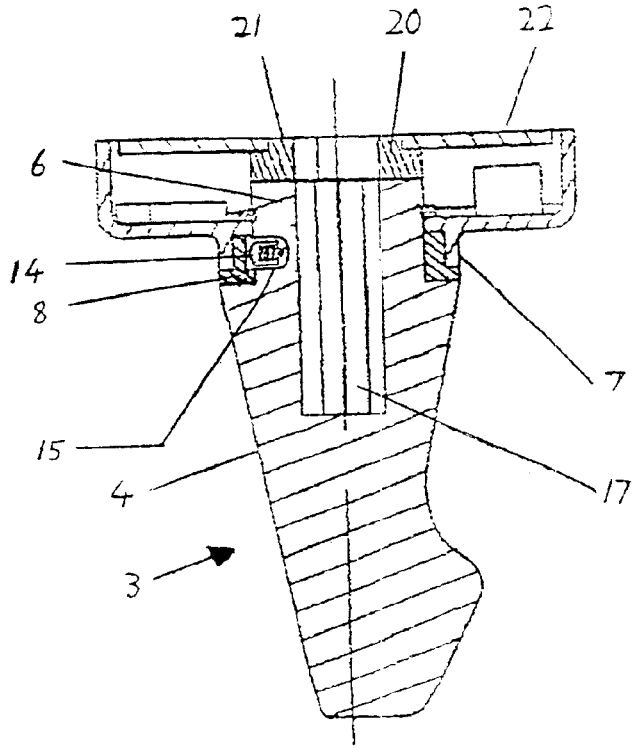

When the handle 3 of the locking device 1 is in its rest position shown in FIG. 2, the locking bar 26 is aligned with the notch 24 in the locking bush 20 but is prevented from being urged into engagement with the notch by the cam surface on the cylindrical handle part 6. In this position, the detent 14 engages the first pocket 12 in the sleeve 8 to index the handle in its rest position.

To open a door fitted with the locking device 1, the lever arm 5 of the handle 3 is turned in a clockwise direction from its rest position, when viewed from the front. When turned in this direction, the ribs 19 of the handle body 4 couple and engage the square section of the latch bar 18 so that the latter turns with the handle and, hence, the latch bolt is retracted allowing the door to be opened. At the same time, the locking bush 20 also rotates with the latch bar. The turning of the handle body 4 causes the detent 14 to disengage from the first pocket 12 in the sleeve 8. When the lever arm 5 is released, the latch bar turns under the action of the latch spring in an anti-clockwise direction causing the handle 3 and locking bush 20 to return to the rest position where the detent 14 re-enters the pocket 12 to index,the handle in this rest position.

To lock the door, the handle 3 is lifted upwardly from its rest position, in an anti-clockwise direction. In this direction of rotation, because of the design of the ribs 19, the handle turns relatively to the latch bar 18 and locking bush 20. The turning of the handle causes the detent 14 to disengage from the first pocket 12. As the handle body 4 rotates, the camming recess 31 moves into contact with the cam follower portion 30 of spring loaded locking bar 26 enabling the latter to fall into engagement with the notch 24 in the locking bush 20 which, in the indexed rest position of the handle, is aligned with the locking bar 26 thereby locking the latch bolt in its extended position. As the door locks, the detent 14 engages the second pocket 13 to index the handle in this locked position. Further anti-clockwise movement of the handle is positively prevented by the cam follower engaging the stop side 32 of the cam recess 31. The latch bolt is, thus, firmly locked against turning, preventing operation of the latch from the opposite side of the door. The door is thus locked. Returning the handle clockwise to its rest position reverses the movement described above. The inclined side 33 of the camming recess 31 eases the locking bar 26 radially outwardly from the body 4 in response to the latter being turned and causes the locking bar to disengage from the locking bush 20, thereby releasing the latch bar so that it can be turned from the opposite side of the door.

Figure 13:
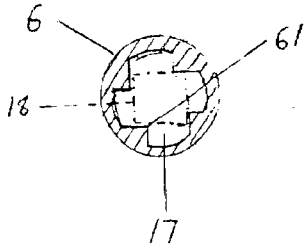
FIGS. 13 to 16 illustrate alternative details.

In a modification shown in FIG. 13 (which is similar to FIG. 7), the passageway 17 in the cylindrical part 6 of the handle has an internal profile formed from an alternative arrangement of longitudinally extending ribs 61.

Figure 14:
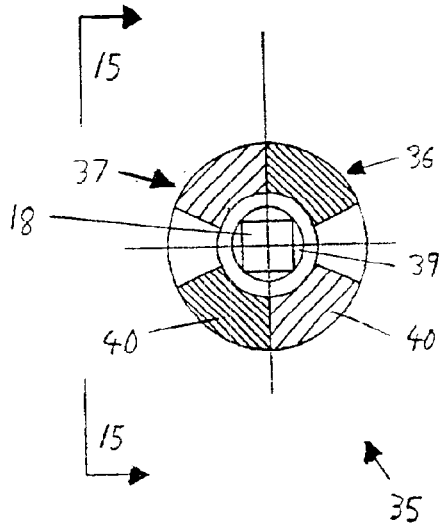
Figure 15:
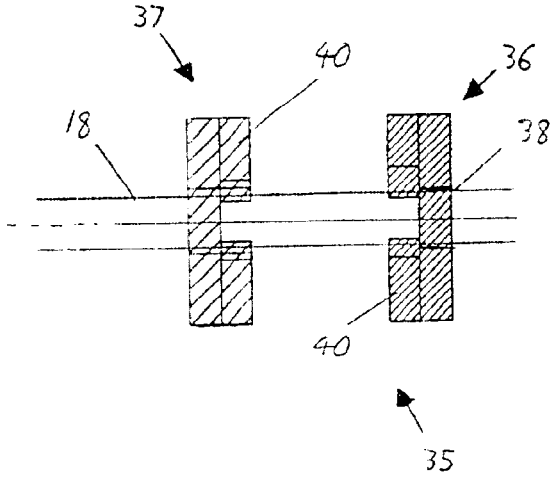

In another modification shown in FIGS. 14 and 15, the locking device includes a dog clutch 35 having two halves 36,37. The first clutch half 36 has a square shaped aperture 38 and the latch bar engages within the aperture so as to couple the first clutch half to the latch bar. This first clutch half replaces, or is fixed to, the locking bush 20. The second clutch half 37 is attached to the inner end of the handle body and has a circular shaped aperture 39 through which the latch bar freely projects. The latch bar is also freely rotatable within the handle body passageway.

Each half of the clutch has a pair of lugs 40 which respectively abut against the lugs 40 in the opposing clutch half when the locking device is in its rest position. When the handle is turned clockwise from its rest position, the engaged lugs cause both halves 36,37 of the clutch to rotate, which turns the latch bar 18 to retract the latch bolt. When, however, the lever arm is turned anti-clockwise from the rest position, the pairs of lugs are disengaged, thereby allowing the handle to turn relative to the latch bar and the locking block to move into locking relation with the latch bar under control of the cam member.

Figure 16:
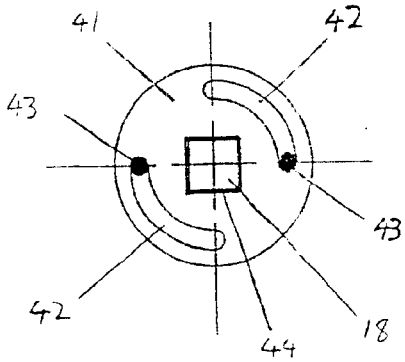

In yet another modification shown in FIG. 16, the locking device includes a circular plate 41 which has a pair of opposing arcuate slots 42 engaged by a pair of pegs 43. The circular plate has a square shaped aperture 44 within which the latch bar 18 engages so as to couple the circular plate to the latch bar. This circular plate replaces, or is fixed to, the locking bush 20 of the first embodiment. The pegs project from the inner end of the handle body which is freely rotatable relatively to the latch bar. When the handle is turned clockwise from the rest position, the pegs are forced against the ends of the arcuate slots 42, causing the latch bar 18 to rotate. When, however, the handle arm is turned anti-clockwise from the rest position, the pegs travel freely along the slots enabling the handle to turn relative to the latch bar.

An advantage of the above described embodiment is that the locking device can be easily attached to one side of a door, replacing any existing door handle arrangement on that side of the door. The door handle arrangement on the other side of the door need not be changed. The locking device does not require a receiving cavity to be chiselled into the body of a door between opposite sides of the door or any other form of carpentry work to be performed.

Moreover, the operation of the locking device is simple. With the door closed, the handle of the locking device is turned upwards, for example, through 45°, and this locks the latch bar extending through the door and, hence, the latch. The door cannot then be opened from the opposite side. However, in the case of emergency, such as a fire, the door is simply and quickly opened by the normal method of pulling the handle down. Practical tests have shown that it is far quicker to operate than any other form of lock, whether this be a key or bolt, and there is no fumbling in the case of panic as it is the natural way to open the door.

Figure 17:
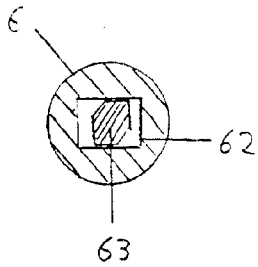
FIGS. 17 and 18 are details of another embodiment of the invention.

In a second embodiment shown in FIG. 17, the cylindrical part 6 of the handle has a blind, rectangular section passageway 62 extending into the handle body for fitting to the latch bar 63 which has an external profile defined by the bar being hexagonal in cross-section. This enables the handle to engage and turn the latch bar 63, when the handle is turned in a clockwise direction from the rest position, and enables the handle to turn relatively to the latch bar when the handle is turned in an anti-clockwise direction from the rest position.

Figure 18:
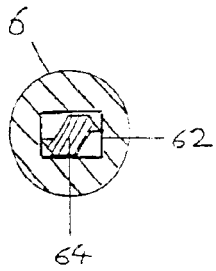
Figure 19:
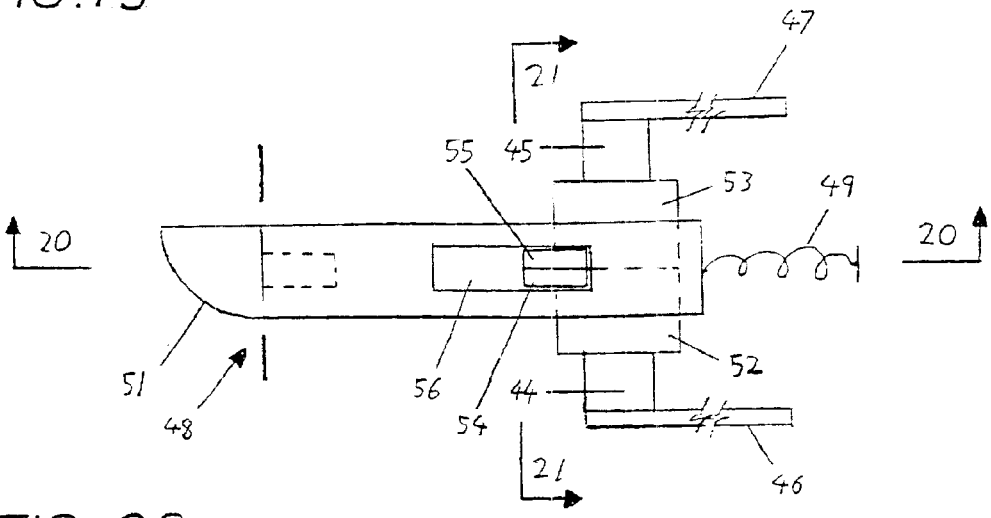
FIG. 19 is a plan view of yet another embodiment of the invention.
Figure 20:
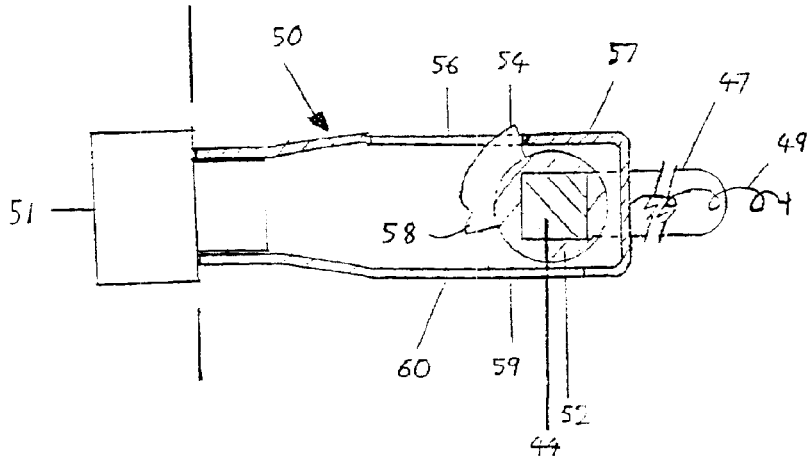
FIGS. 20 and 21 are sectional views taken along lines 20—20 and lines 21—21, respectively, of FIG. 19.
Figure 21:
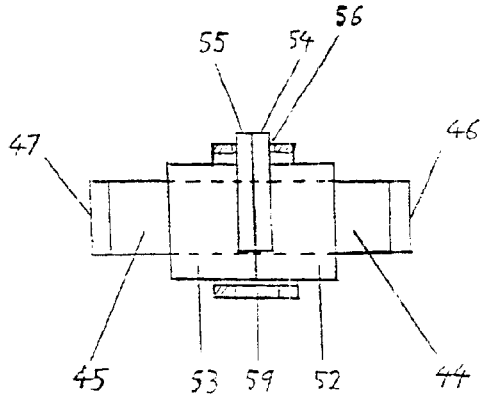

In a modification shown in FIG. 18 to the second embodiment, the hexagonal section latch bar has been replaced by a latch bar 64 which has an external profile defined by the bar being "S" shaped in cross-section.

FIGS. 19 to 27 illustrate a third embodiment of the invention which essentially consists in a modified door rim latch very similar to those in current use and which is intended to be inset within the body of a door between opposite sides of the door. In this embodiment, instead of a latch bar of square cross section extending through the latch and the door, the latch bar is split into first and second coaxial latch bar members 44,45 each projecting from one side of the door and having a lever door handle 46,47 fitted thereto for turning the latch bar member. The two handles are suitably journalled and operate independently of one another. The latch includes a latch bolt 48 which is resiliently urged into a latching position by a compression spring 49. The latch bolt has a hollow latch body 50 formed as a pressing and having a solid nose 51 for engaging a co-operating catch on the door frame. The latch bar members project into the latch body and each member has a cam 52,53 attached to its end projecting into the body. These cams control movement of the latch bolt and each cam has an acurate flange 54,55 projecting from the cam about part of its circumference. The cam flanges are arranged to engage a slot 56 in the top part 57 of the body 50 of the latch bolt and, in the rest position illustrated in FIGS. 19, 20 and 21, where the latch bolt is urged into engagement with its co-operating catch by the compression spring 49, the radial edges of the flange are in contact with the body 50 and the handles are horizontal. The cam flange associated with at least one of the handles is formed with an additional lug 58 at the peripheral end of the flange opposite that engagable with the end of the slot 56 which, when the latch bolt is in its extended, latching position can engage with a co-operating slot 59 in the bottom part 60 of the latch body. When the latch is in its latching position, turning of the relevant latch handle 46 or 47 in an anti-clockwise direction moves the associated cam flange 52,53 so as to engage the lug 58 with the slot 59 and prevents the latch bolt from being retracted.

Figure 22:
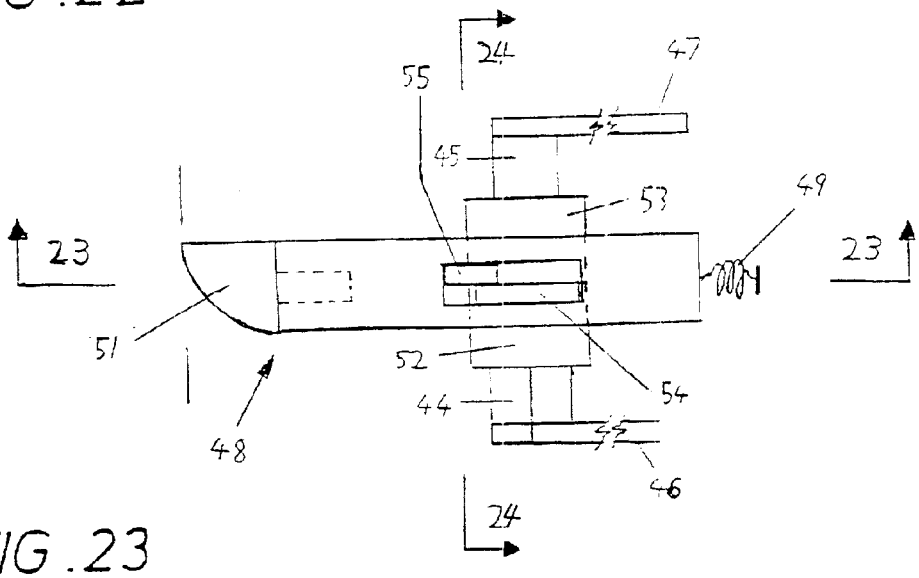
FIG. 22 is a plan view of the locking device of FIG. 19 shown in its released position.
Figure 23:
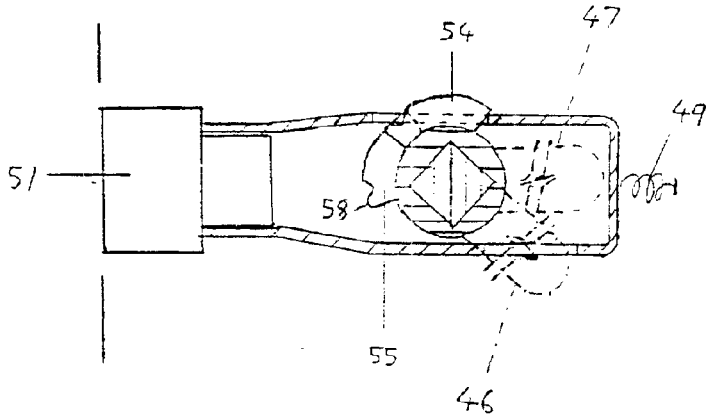
FIGS. 23 and 24 are sectional views taken along lines 23—23 and lines 24—24, respectively, of FIG. 22.
Figure 24:
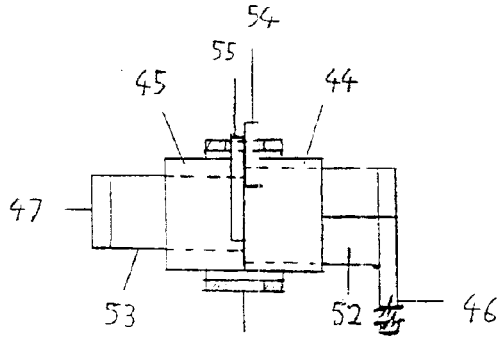
Figure 25:
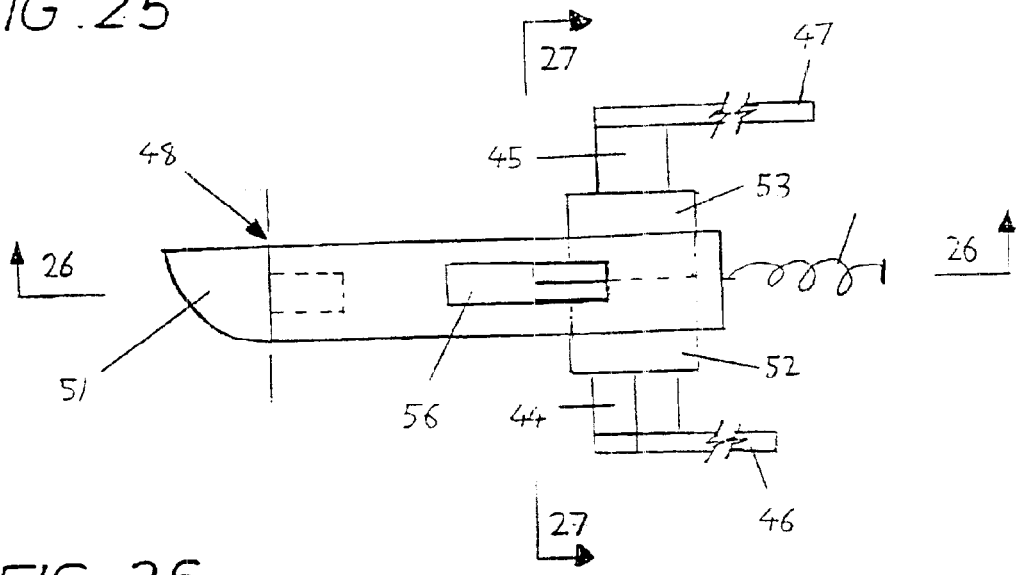
FIG. 25 is a plan view of the locking device of FIG. 19 shown in its locked position.
Figure 26:
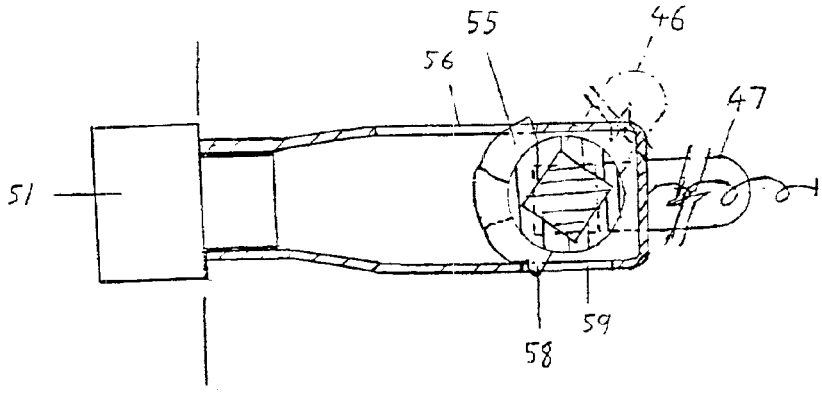
FIGS. 26 and 27 are sectional views taken along lines 26—26 and lines 27—27, respectively, of FIG. 25.
Figure 27:
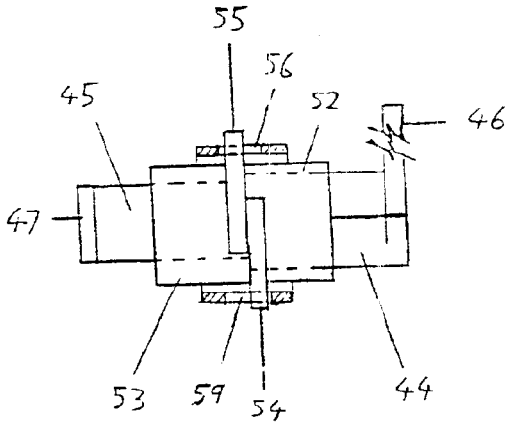

Hence, if either handle is turned, for example, through 45°, in this case, downwardly from the rest position, either cam operates the latch, by means of its acurate flange actuating the latch body, and opens the latch bolt 50 in a normal manner, as shown in FIGS. 22, 23 and 24. However, if the handle with the locking lug is moved through 45° anti-clockwise from the rest position, its cam lug 58 engages in the slot 59 in the bottom of the latch body, as illustrated in FIGS. 25, 26 and 27, and prevents the latch from being retracted if any attempt is made to move the other door handle. The door is thus locked. The non-locking side of the door has a handle which will not move from the horizontal position in an anti-clockwise manner so that a door can only be locked from one side.

Whilst particular embodiments have been described it will be understood that various modifications may be made without departing from the scope of the invention as defined by the appended claims. For example, the locking device could be easily adjusted to be operated by a left-handed lever arm instead of a right-handed lever arm. The direction of rotation of the lever arm can be reversed to lock or open the door respectively. The lever arm may be replaced by a knob. The components of the locking device may be made of any suitable material. In the last described embodiment, a catch may be used to retain or index the first handle in place in order to lock the door from the opposite side.

What is claimed is

1. A locking device for a door a latch mechanism comprising a latch bolt, latch bar coupled to the latch bolt and rotatable to retract the latch bolt, and door handles connected to opposite ends of the latch bar for rotating the latch bar to cause retraction of the latch bolt, the locking device being operable in response to turning of one door handle to prohibit turning of the latch bar by the other door handle, the locking device comprising:

rotatable first locking means comprising first coupling means for coupling to the latch bar;

second locking means for engaging said rotatable first locking means and preventing turning thereof; and cam means for controlling operation of said second locking means, said cam means comprising second coupling means for coupling to the latch bar;

said rotatable first locking means and said cam means being turnable relative to one another when coupled to the latch bar by the respective first and second coupling means thereof so that said second locking means is operable to engage said rotatable first locking means in response to turning of said cam means in one direction relative to said rotatable first locking means and so that whereafter said second locking means is operable to disengage from said rotatable first locking means upon turning said cam means in an opposite direction;

said rotatable first locking means comprising a rotatable locking member and detent means on a periphery thereof, and said second locking means comprising a movable locking member operatively controlled by said cam means for engagement with said detent means.

2. The locking device of claim 1, wherein one of said first and second coupling means is engageable with the latch bar so that the associated one of said rotatable first locking means and said cam means is rotatable with the latch bar, and wherein the other of said first and second coupling means is adapted to couple the other of said rotatable first locking means and said cam means to the latch bar so as to be turnable relative to the latch bar, and hence said one of said rotatable first locking means and said cam means through a predetermined arc of rotation.

3. The locking device of claim 2, wherein said first coupling means is adapted to couple said rotatable first locking means to the latch bar for rotation of said first locking means therewith, and wherein said second coupling means is adapted to couple said cam means to said latch bar such that said cam means is turnable relative to the latch bar, and hence said rotatable first locking means through the predetermined arc of rotation.

4. The locking device of claim 2, wherein the other of said first and second coupling means defines a passageway for fitting to the latch bar, and wherein the passageway has an internal profile which enables the other of said rotatable first locking means and said cam means to turn through the predetermined arc of rotation relative to the latch bar.

5. The locking device of claim 1, wherein one of said first and second coupling means engages with the latch bar for rotation of the associated one of said rotatable first locking means and said cam means therewith, and wherein the other of said first and second coupling means mounts the other of said rotatable first locking means and said cam means on the latch bar for rotation relative to the latch bar, and further comprising interconnecting means for connecting said rotatable first locking means to said cam means to permit said first locking means and said cam means to turn through a limited arc of movement relative to one another.

6. The locking device of claim 1, wherein one of said rotatable first locking means and said cam means is formed on a rotatable body portion for a door handle.

7. The locking device of claim 1, further comprising a housing, wherein said rotatable first locking means and said cam means are rotatably mounted in said housing for rotation relative to said housing about a common axis, and wherein said housing is adapted to be secured in a fixed position on a door relative to said latch mechanism with said first and second coupling means of said rotatable first locking means and said cam means fitted to an adjacent end of the latch bar.

8. The locking device of claim 1, wherein said movable locking member comprises a slidable locking member operatively controlled by said cam means for engagement with said detent means.

9. The locking device of claim 8, wherein said cam means has a recess engageable with said slidable locking member to permit said slidable locking member to move into engagement with said detent means, and wherein said recess has a stop portion at one end which restricts further turning movement of said cam means in the one direction upon engagement of said locking member with said recess, and a ramp portion at its opposite end to urge said locking member from said recess as said cam means is turned in the opposite direction.

10. A locking device for a door latch mechanism comprising a latch bolt, door handles, and a latch bar coupled to the latch bolt and having opposite ends coupled to the door handles so that rotation of the latch bar causes retraction of the latch bolt, the locking device being operable in response to turning of one door handle to prohibit turning of the latch bar by the other door handle, the locking device comprising:

a housing for securing in a fixed position to a door;

a rotatable locking member rotatably mounted in said housing, said rotatable locking member having an external periphery and a central aperture defining an internal periphery, said external periphery of said rotatable locking member comprising detent means;

a slidable locking member engageable with said detent means and mounted in said housing for movement towards and away from said external periphery of said rotatable locking member;

a spring urging said slidable locking member towards said external periphery of said rotatable locking member;

cam means rotatably mounted in said housing means coaxially with said rotatable locking member, said cam means having an external periphery with a cam profile and a central aperture defining an internal periphery of said cam means; and cam follower means on said slidable locking member engaging said cam profile so that said cam means controls sliding movement of said slidable locking member, said cam profile permitting said slidable locking member to move inwardly to engage said detent means of said rotatable locking member to lock said rotatable locking member against rotation;

the central apertures in said rotatable locking member and said cam means being adapted to fit onto an adjacent end of the latch bar, said internal periphery defined by one of said central apertures substantially corresponds in shape to the external periphery of the latch bar such that the associated one of said rotatable locking member and said cam means is rotatable with the latch bar, and said internal periphery of the other of said central apertures having a configuration which enables the other of said rotatable locking member and said cam means to turn relative to the latch bar through a limited arc of movement so that when said cam means is turned in one direction, said cam profile and cam follower means cooperate to permit said slidable locking member to engage said detent means of said rotatable locking member, and so that whereafter turning of said cam means in an opposite direction causes said cam profile and cam follower means to cooperate to disengage said slidable locking member from said detent means.

11. The locking device of claim 10, wherein said internal periphery of said rotatable locking member substantially corresponds in shape to said external periphery of said latch bar such that said rotatable locking member is rotatable with the latch bar, and wherein said internal periphery of said cam means is configured to enable said cam means to turn relative to the latch bar, and hence said rotatable locking member, through said limited arc of movement.

12. The locking device of claim 11, wherein a body portion for a door handle is rotatably mounted in said housing, wherein said cam means is formed on an end of said body portion, and wherein said central aperture of said cam means comprises a passageway in said body portion for fitting said body portion to an adjacent end of the latch bar.

13. The locking device of claim 12, wherein said detent means comprises a notch in said external periphery of said rotatable locking member, wherein said cam profile includes a cam recess engageable with said cam follower means to permit said slidable locking member to move into engagement with said notch, wherein said cam recess has a stop portion at one end which cooperates with said cam follower means to restrict turning movement of said cam means relative to said rotatable locking member in the one direction to define one end of said limited arc of movement, and wherein said cam recess has a ramp portion at its opposite end for lifting said cam follower means from said cam recess and said slidable locking member from said notch when said cam means is turned in the opposite direction.

14. The locking device of claim 13, further comprising cooperating indexing means on said body portion and said housing for indexing said body portion in positions at opposite ends of said limited arc of movement and corresponding respective to a position in which said slidable locking member is disengaged from said notch so that said latch bar is unlocked, and a position in which the slidable locking member engages said notch so that the latch bar is locked against turning by the other door handle.

15. The locking device of claim 11, wherein said internal periphery of said cam means comprises axially extending spaced ribs which are arranged so as to enable said cam means to engage and turn said latch bar when said cam means is turned in one direction from a rest position and enables said cam means to turn relatively to said latch bar when said cam means is turned in the opposite direction from the rest position.

16. A door latch mechanism comprising: a slidable latch bolt for engaging a keeper on a door frame;

latch bar means coupled to said latch bolt and turnable to retract said latch bolt by turning of door handles secured to opposite projecting ends of said latch bar means; and a locking device which is actuated by turning of one of the door handles in one direction to prohibit turning of said latch bar means and retraction of said latch bolt by turning of the other door handle so that whereafter said locking device is released by turning of the one handle in the opposite direction, said locking device comprising rotatable first locking means coupled to said latch bar means, and second locking means engageable with said first locking means, said rotatable first and second locking means being engageable in response to rotation of said latch bar means by turning the one door handle in the one direction so that whereafter said rotatable first and second locking means are disengageable in response to rotation of said latch bar means by turning the one door handle in the opposite direction;

said rotatable first locking means comprising a rotatable locking member having a locking detent disposed in a periphery of said rotatable locking member, and said second locking means comprising a movable locking member operatively controlled by a cam means for engagement with said locking detent.

17. The door latch mechanism of claim 16, wherein said latch bar means comprises a single integral latch bar projecting from opposite sides of said door latch mechanism for receiving the door handles, wherein said cam means is coupled to said single integral latch bar for controlling operation of said second locking means, and wherein said rotatable first locking means and said cam means are turnable relative to one another so that said second locking means is operable by said cam means to engage said rotatable first locking means in response to turning of said cam means in one direction relative to said rotatable first locking means so that whereafter said second locking means is operable to disengage said second locking means from said rotatable first locking means by turning said cam means in the opposite direction relative to said rotatable first locking means.

18. The latch mechanism of claim 17, wherein said rotatable first locking means is coupled to said single integral latch bar for rotation of said rotatable first locking means therewith, and wherein said cam means is coupled to said single integral latch bar such that said cam means is turnable relative to said single integral latch bar, and hence said first rotatable locking means, through a predetermined arc of rotation.

19. The latch mechanism of claim 18, wherein said cam means comprises a passageway for coupling said cam means to said single integral latch bar, and wherein said passageway has an internal profile which enables said cam means to turn through the predetermined arc of rotation relative to said single integral latch bar.

20. The latch mechanism of claim 18, further comprising connecting means interconnecting said first locking means and said cam means, wherein said connecting means enables said cam means to turn relative to said rotatable first locking means through the predetermined arc of movement when said cam means turns in the one direction and enabling said cam means to turn said rotatable first locking means and said single integral latch bar when turned in the opposite direction.

21. The latch mechanism of claim 18, wherein said cam means is an integral part of a rotatable body portion of the one door handle.

22. The latch mechanism of claim 16, wherein said movable locking member comprises a slidable locking member operatively controlled by said cam means for engagement with said locking detent.

23. A door latch mechanism comprising: a slidable latch bolt for engaging a keeper on a door frame;

latch bar means coupled to said latch bolt and turnable to retract said latch bolt by turning of door handles secured to opposite projecting ends of said latch bar means; and a locking device which is actuated by turning of one of the door handles in one direction to prohibit turning of said latch bar means and retraction of said latch bolt by turning of the other door handle so that whereafter said locking device is released by turning of the one handle in the opposite direction, said locking device comprising rotatable first locking means coupled to said latch bar means, and second locking means engageable with said first locking means, said rotatable first and second locking means being engageable in response to rotation of said latch bar means by turning the one door handle in the one direction so that whereafter said rotatable first and second locking means are disengageable in response to rotation of said latch bar by turning the one door handle in the opposite direction;

said latch bar means comprising coaxial latch bars and each latch bar having said first locking means engageable with said second locking means to prohibit retraction of said latch bolt in response to turning of either of said latch bars relative to the other said latch bar in the one direction.

24. The door latch mechanism of claim 23, wherein said second locking means comprises means disposed on said slidable latch bolt for engaging with said first locking means.

25. The door latch mechanism of claim 24, wherein said first locking means comprises a radial flange on each said latch bar, wherein said radial flange has catch means formed at one end thereof for engagement with said second locking means, wherein said radial flange has means at its opposite end engageable with said latch bolt for retracting said latch bolt when said latch bar is turned in the opposite direction from a rest position by the one door handle, and wherein said catch means is engageable with said second locking means in response to turning of said latch bar in the one direction from a rest position by the one door handle so as to engage said second locking means and prohibit retraction of said latch bolt.

26. A door latch mechanism comprising:

a slidable latch bolt for engaging a keeper on a door frame;

latch bar means coupled to said latch bolt and turnable to retract said latch bolt by turning of door handles secured to opposite projecting ends of said latch bar means; and a locking device which is actuated by turning of one of said door handles of said latch mechanism in one direction to prohibit turning of said latch bar means and retraction of said latch bolt by turning of the other door handle so that whereafter said locking device is released by turning of the one handle in the opposite direction, said locking device comprising rotatable first locking means coupled to said latch bar means, and second locking means engageable with said first locking means, said rotatable first and second locking means being engageable in response to rotation of said latch bar means by turning the one door handle in the one direction so that whereafter said rotatable first and second locking means are disengageable in response to rotation of said latch bar means by turning the one door handle in the opposite direction;

said rotatable first locking means comprising a rotatable locking member having a locking detent disposed on a periphery of said rotatable locking member, and said second locking means comprising means disposed on said slidable latch bolt for engaging with said locking detent.

27. The door latch mechanism of claim 26, wherein said rotatable first locking means comprises a radial flange on said latch bar means, wherein said radial flange has said locking detent formed at one end thereof for engagement with said second locking means, wherein said radial flange has means at its opposite end engageable with said latch bolt for retracting said latch bolt when said latch bar is turned in the opposite direction from a rest position by the one door handle, and wherein said locking detent is engageable with said second locking means in response to turning of said latch bar means in the one direction from a rest position by the one door handle so as to engage said second locking means and prohibit retraction of said latch bolt.

28. The door latch mechanism of claim 27, wherein said latch bar means comprises coaxial latch bars and each latch bar has said first locking means engageable with said second locking means to prohibit retraction of said latch bolt in response to turning of either of said latch bars relative to the other said latch bar in the one direction.

* * * * *